US011707692B1

(12) United States Patent
Matarazzo

(10) Patent No.: US 11,707,692 B1
(45) Date of Patent: Jul. 25, 2023

(54) DEPLOYABLE PORTABLE RAMP AND METHODS

(71) Applicant: Anthony Matarazzo, Escondido, CA (US)

(72) Inventor: Anthony Matarazzo, Escondido, CA (US)

( * ) Notice: Subject to any disclaimer, the term of this patent is extended or adjusted under 35 U.S.C. 154(b) by 0 days.

(21) Appl. No.: 18/096,212

(22) Filed: Jan. 12, 2023

Related U.S. Application Data

(60) Provisional application No. 63/332,159, filed on Apr. 18, 2022.

(51) Int. Cl.
*A63H 18/02* (2006.01)
*A63F 9/02* (2006.01)
*A63H 30/04* (2006.01)

(52) U.S. Cl.
CPC ..... *A63H 18/028* (2013.01); *A63F 9/0204* (2013.01); *A63H 30/04* (2013.01)

(58) Field of Classification Search
CPC .... A63H 18/02; A63H 18/021; A63H 18/028; A63H 18/04; A63H 18/06; A63H 30/04
USPC ..... 273/348; 446/93, 108, 109, 444, 478, 446/488; 472/88, 89, 90
See application file for complete search history.

(56) References Cited

U.S. PATENT DOCUMENTS 2,187,524 A * 1/1940 Price ..... A63F 7/40 273/393
3,009,700 A * 11/1961 Dolega ..... A63B 65/12 124/79
3,033,570 A * 5/1962 Mathes ..... A63F 7/0017 273/120 R
3,398,956 A * 8/1968 Lukes ..... A63F 9/02 273/357
3,709,495 A * 1/1973 Krombein ..... A63F 9/02 473/569
4,113,255 A * 9/1978 Goldfarb ..... A63H 18/00 273/108
4,129,916 A * 12/1978 Schlesinger ..... E01C 13/003 404/1
4,285,514 A * 8/1981 Romero ..... A63G 31/00 472/89
4,310,271 A * 1/1982 Canellis ..... B60P 3/07 410/23
4,733,871 A * 3/1988 McQueeny ..... A63F 9/02 273/271
5,165,690 A * 11/1992 Kelley, Jr. ..... A63B 63/007 472/88
5,234,216 A * 8/1993 Ostendorff ..... A63H 18/028 273/127 R
5,435,570 A * 7/1995 Labrasseur ..... A63F 9/02 473/569
5,524,310 A * 6/1996 Farnen ..... E01C 13/003 404/1
5,599,235 A * 2/1997 Lynberg ..... A63C 19/10 472/89

(Continued)

*Primary Examiner* — Joseph B Baldori
(74) *Attorney, Agent, or Firm* — Procopio Cory Hargreaves and Savitch LLP

(57) ABSTRACT

A method of using a ramp for jumping wirelessly controlled vehicles comprising assembling one or more two-dimensional ramp supports into a three-dimensional configuration; coupling a two-dimensional ramp member to the one or more three-dimensional ramp supports to form a ramp with a three-dimensional ramp member; providing the ramp so that it is supported on a surface by the one or more three-dimensional ramp supports.

13 Claims, 11 Drawing Sheets

(56) References Cited

U.S. PATENT DOCUMENTS 6,042,480 A * 3/2000 Labelson ..... A63C 19/10 472/89
6,102,405 A * 8/2000 Spikes ..... A63F 9/0252 273/351
6,216,600 B1 * 4/2001 Verret ..... A63H 18/028 248/237
6,350,174 B1 * 2/2002 Halford ..... A63H 18/028 446/478
6,676,529 B2 * 1/2004 Pernal ..... A63C 19/10 472/89
6,776,685 B2 * 8/2004 Reisher ..... A63H 18/00 446/444
7,261,614 B2 * 8/2007 Laurienzo ..... A63H 18/028 446/444
8,128,092 B2 * 3/2012 Ritter ..... A63F 9/02 273/292
8,196,244 B2 * 6/2012 Mapp ..... E01C 13/003 472/89
8,469,831 B2 * 6/2013 Jobe ..... A63K 1/00 446/444
8,939,812 B2 * 1/2015 Chan ..... A63H 30/02 446/454
8,992,282 B2 * 3/2015 Desent ..... A63H 18/026 446/168
9,174,115 B2 * 11/2015 Vaughan ..... A63H 33/16
10,035,073 B2 * 7/2018 Bergan ..... A63H 33/16
10,065,095 B2 * 9/2018 Gallagher ..... A63F 9/305
10,166,459 B1 * 1/2019 Chen ..... E01D 15/133
2007/0049160 A1 * 3/2007 Matthes ..... A63H 18/02 446/444
2007/0197126 A1 * 8/2007 Derrah ..... A63H 7/00 446/288
2011/0014844 A1 * 1/2011 Henson ..... A63H 18/028 446/85
2011/0021110 A1 * 1/2011 Hippely ..... A63H 18/021 446/444
2012/0012664 A1 * 1/2012 Nakayama ..... A63H 18/028 238/1 OA

* cited by examiner

DEPLOYABLE PORTABLE RAMP AND METHODS

CROSS REFERENCE TO RELATED APPLICATION

This application claims the benefit of U.S. Provisional Patent Application No. 63/332,159, filed Apr. 18, 2022, under 35 U.S.C. 119, which is incorporated by reference herein.

FIELD OF THE INVENTION

The invention relates to ramps used for jumping wirelessly controlled vehicles.

SUMMARY OF THE INVENTION

An aspect of the disclosure involves a ramp for jumping wirelessly controlled vehicles and that can be quickly and easily assembled and disassembled. The ramp comprises a light-weight flexible plastic ramp member and one or more light-weight plastic ramp supports that support the ramp member. The ramp member and the ramp supports are in a stacked, flat, two-dimensional configuration in a low-profile/flat configuration during shipping and transport. The ramp member includes an upper surface that wheels of wirelessly controlled vehicles ride over and an undersurface that the ramp supports directly contact and support.

One or more implementations of the above aspect of the disclosure involves one or more of the following: the undersurface includes a first pair/set of longitudinally arranged fasteners, and a second pair/set of longitudinally arranged fasteners; the ramp member includes a lower end and an upper portion including a fold line and an upper end; laterally arranged fasteners for each set of longitudinally arranged fasteners are disposed along the upper end; the ramp supports include a main panel and two side panels that are hinged to the main panel at fold lines; the main panel is rectangular and the two side panels are substantially triangular; the main panel includes a lower end and an upper end with laterally arranged fastener(s); the two side panels include a lower end and an upper end; the lower end of one of the side panels of each ramp support includes ground securement device; the upper end of the side panels includes a curved segment with fastener(s) for most of the upper end and a straight segment 340 with fastener(s) adjacent to the upper end of the main panel; the ramp is part of a game kit that also includes plurality of different-value scoring targets, wherein in the game the different-value scoring targets are spaced at different distances from the ramp, each participant is given three jumps to accumulate the most points, the game may be a single-player game or a multiplayer game; if the participant is unable to launch off the ramp, going off the sides or missing the ramp, the participant forfeits the turn, no more than three runs are allowed per participant; in the event of a tie after three runs, each tied participant gets one extra run until high score winner is determined.

An aspect of the disclosure involves a method of using a ramp for jumping wirelessly controlled vehicles comprising assembling one or more two-dimensional ramp supports into a three-dimensional configuration; coupling a two-dimensional ramp member to the one or more three-dimensional ramp supports to form a ramp with a three-dimensional ramp member; providing the ramp so that it is supported on a surface by the one or more three-dimensional ramp supports.

One or more implementations of the above aspect of the disclosure involves one or more of the following: assembling one or more two-dimensional ramp supports by folding side panels of the ramp supports about vertical fold lines relative to a main panel so that the side panels are 90 degrees and facing in the same direction relative to the main panel; the three-dimensional ramp supports includes a curved segment, and coupling includes coupling the two-dimensional ramp member to the curved segment of the three-dimensional ramp support to form a ramp with a curved, three-dimensional ramp member; the three-dimensional ramp supports includes a straight segment at an upper end, and coupling includes coupling the two-dimensional ramp member to the straight segment of the upper end of the three-dimensional ramp support to form a ramp with a curved, three-dimensional ramp member having a flat upper portion; coupling includes coupling the two-dimensional ramp member to the one or more three-dimensional ramp supports to form a ramp with a three-dimensional ramp member with an undersurface of the two dimensional ramp member facing upward; inverting the assembled ramp after coupling ramp member to the one or more three-dimensional ramp supports so that an upper surface of the ramp member is facing upward; spacing a plurality of different-value scoring targets at different distances from the ramp; wireless controlling a wirelessly controlled vehicle to jump the ramp and land on one of the plurality of different-value scoring targets at different distances from the ramp to score points corresponding to a value of the landed-on scoring target; and/or repeating the jumping step until a predetermined score is achieved or a certain number of jumps is achieved.

DETAILED DESCRIPTION

With reference to FIGS. 1-14, an embodiment of a ramp 100 for jumping wirelessly controlled vehicles (and method of assembly, and method of using) will be described. The ramp 100 is a light-weight portable plastic ramp that can be quickly and easily assembled and disassembled. The ramp 100 is wider, steeper, and much lighter than jumping ramps used with wirelessly controlled vehicles in the past.

Figure 1:
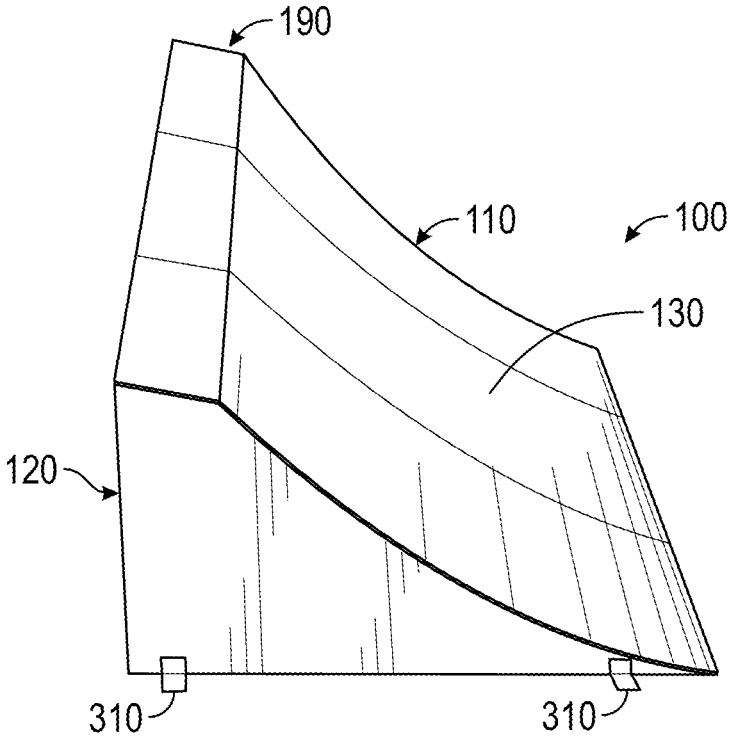
FIG. 1 is a front side perspective view of an embodiment of an assembled ramp for jumping wirelessly controlled vehicles.
Figure 2:
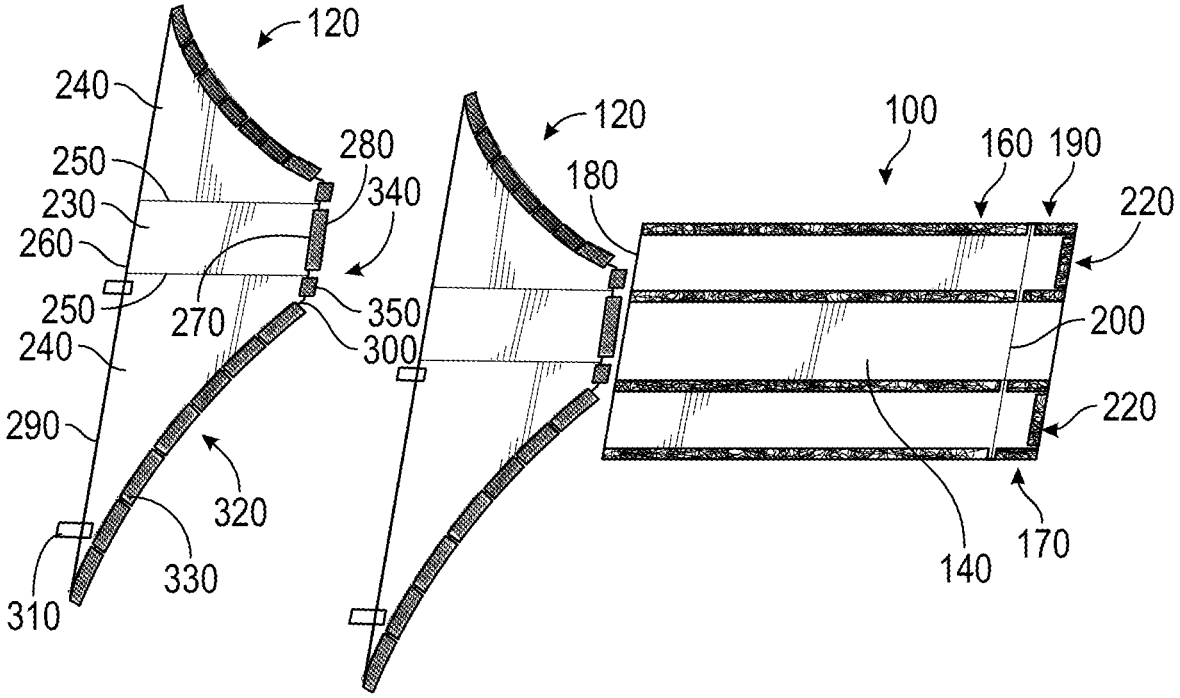
FIG. 2 is an exploded disassembled view of the ramp of FIG. 1 shown in a flat configuration.
Figure 3:
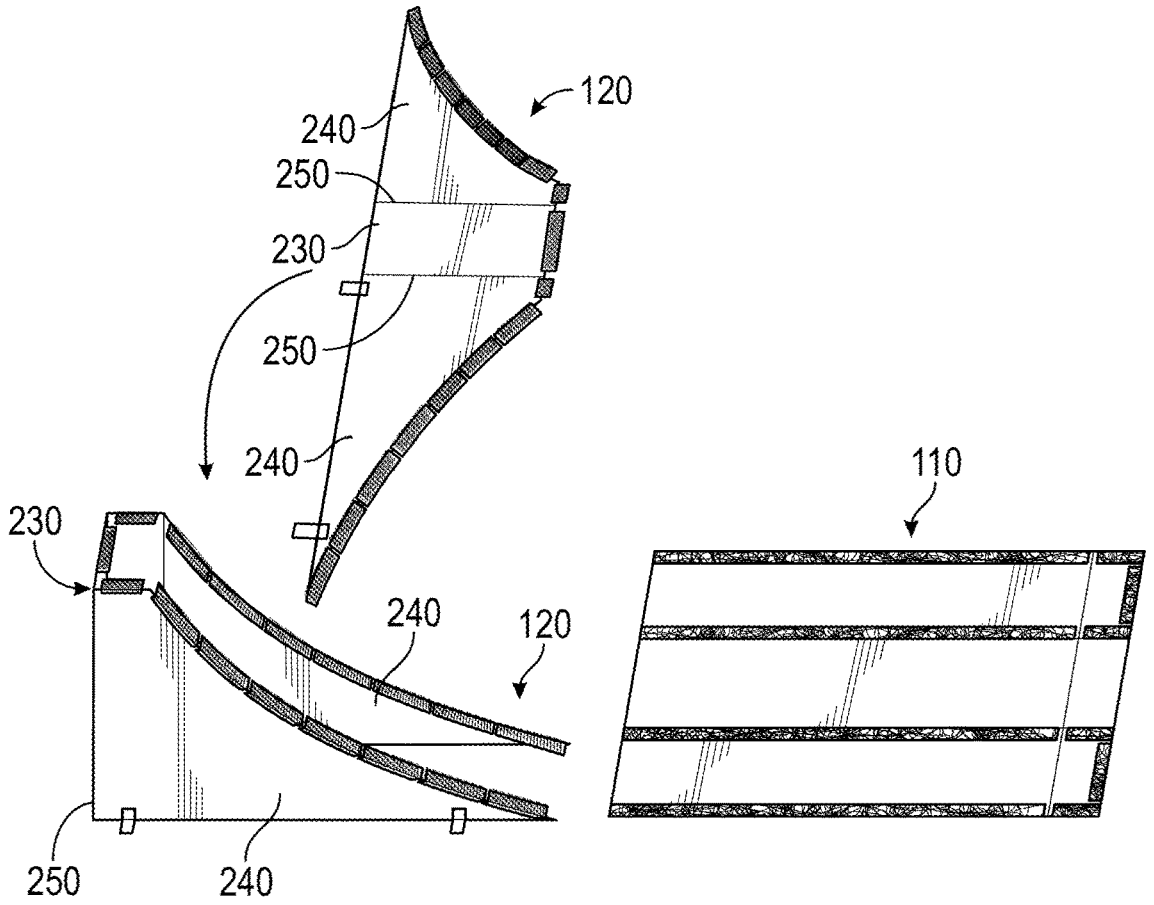
FIG. 3 is a perspective view of a ramp support of the ramp of FIG. 1 being assembled.
Figure 4:
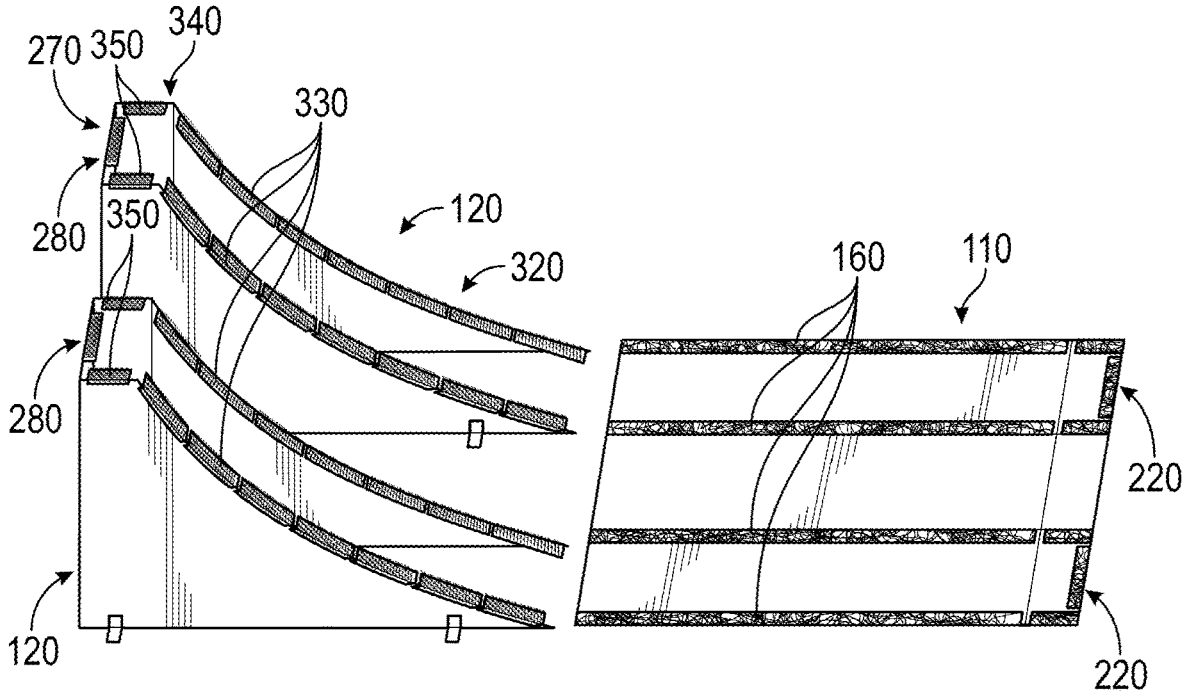
FIG. 4 is a perspective view of a second ramp support of the ramp of FIG. 1 being assembled.
Figure 5:
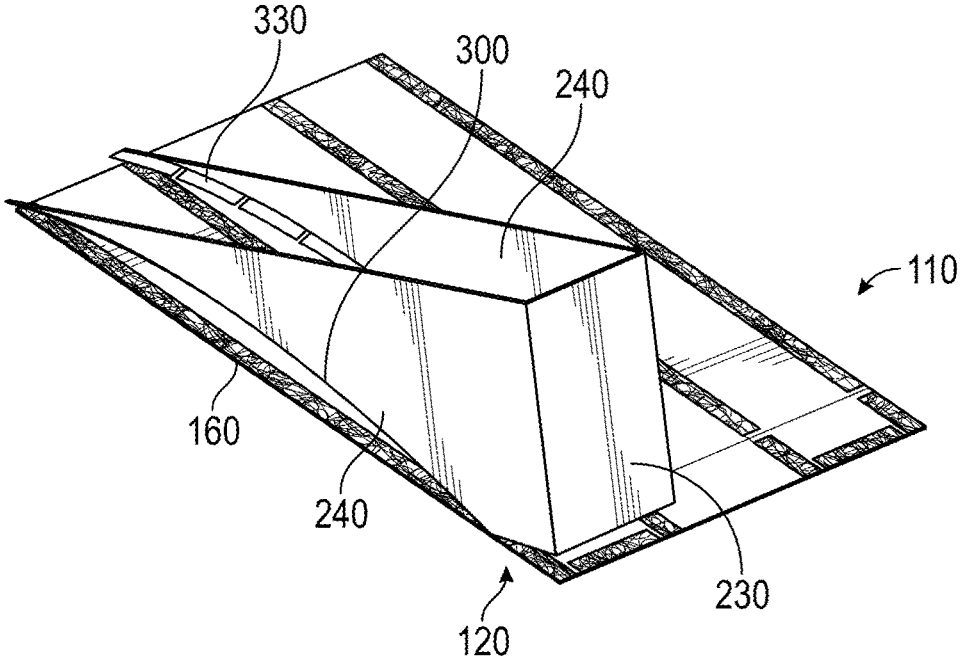
FIG. 5 is a perspective view of an inverted ramp support of the ramp of FIG. 1 being attached to a ramp member of the ramp.
Figure 6:
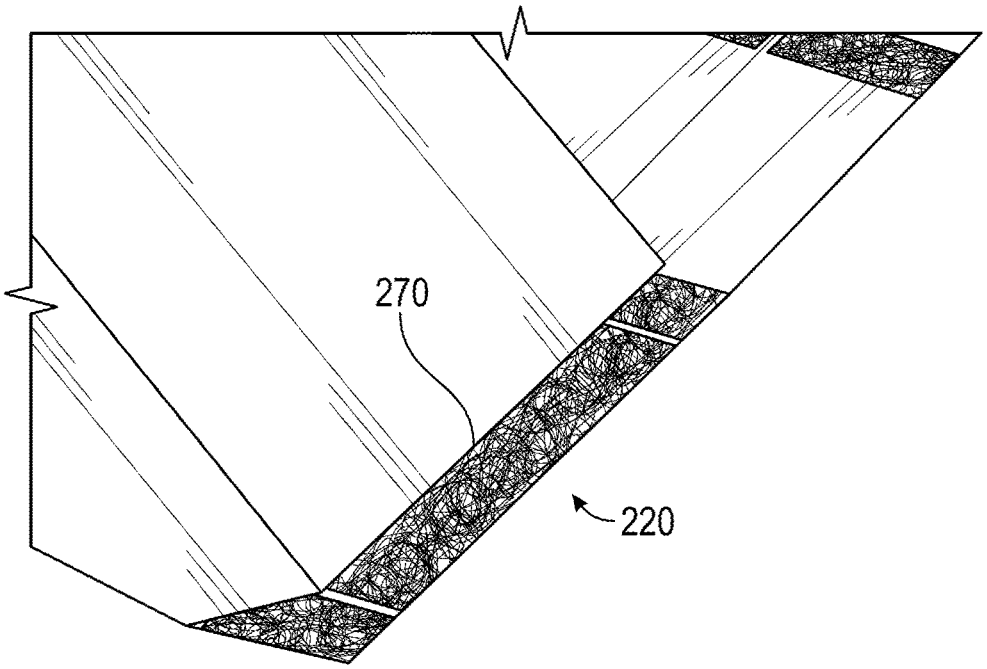
FIG. 6 is an enlarged partial perspective view of the inverted ramp support of FIG. 5 being attached to the ramp member of the ramp of FIG. 1.
Figure 7:
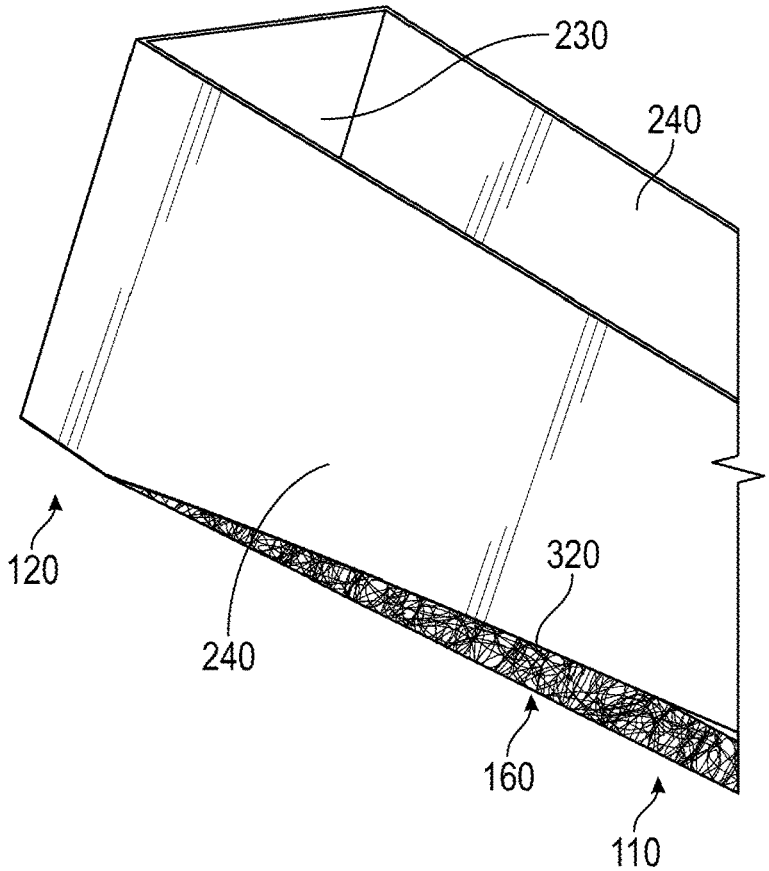
FIG. 7 is another enlarged partial perspective view of the inverted ramp support of FIG. 5 being attached to the ramp member of the ramp of FIG. 1.
Figure 8:
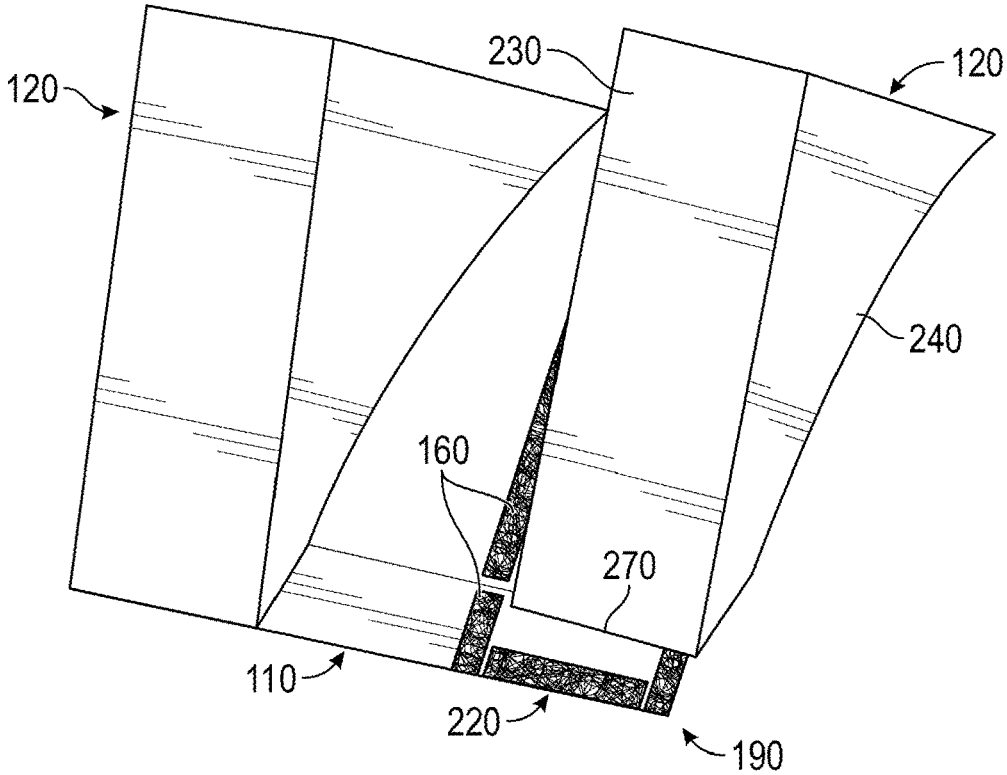
FIG. 8 is a perspective view of the second of two inverted ramp supports of FIG. 4 being attached to the ramp member of the ramp of FIG. 1.
Figure 9:
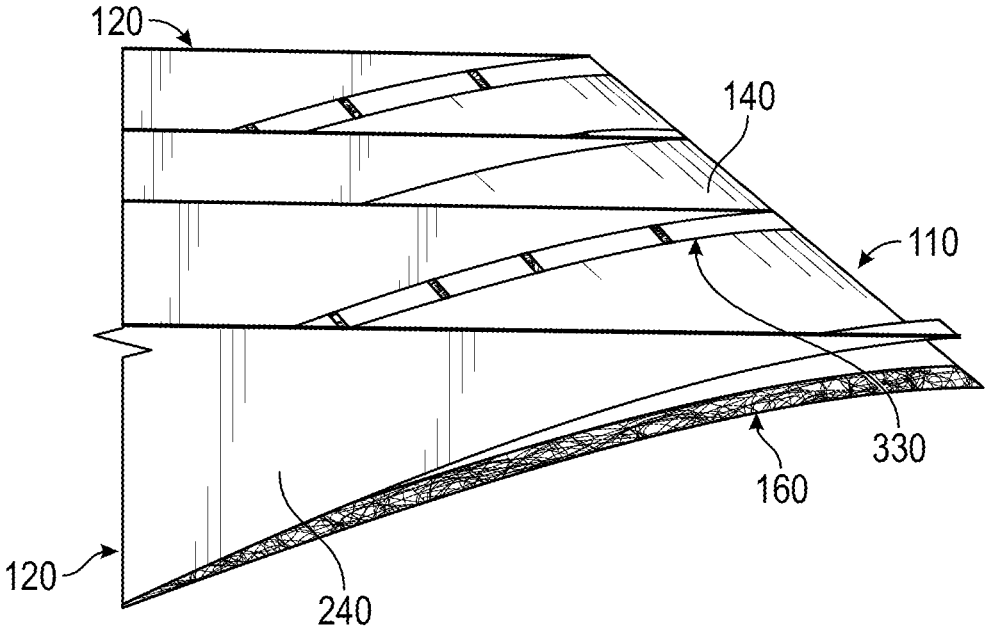
FIG. 9 is a partial perspective view of the second of two inverted ramp supports of FIG. 4 being attached to the ramp member of the ramp of FIG. 1.
Figure 10:
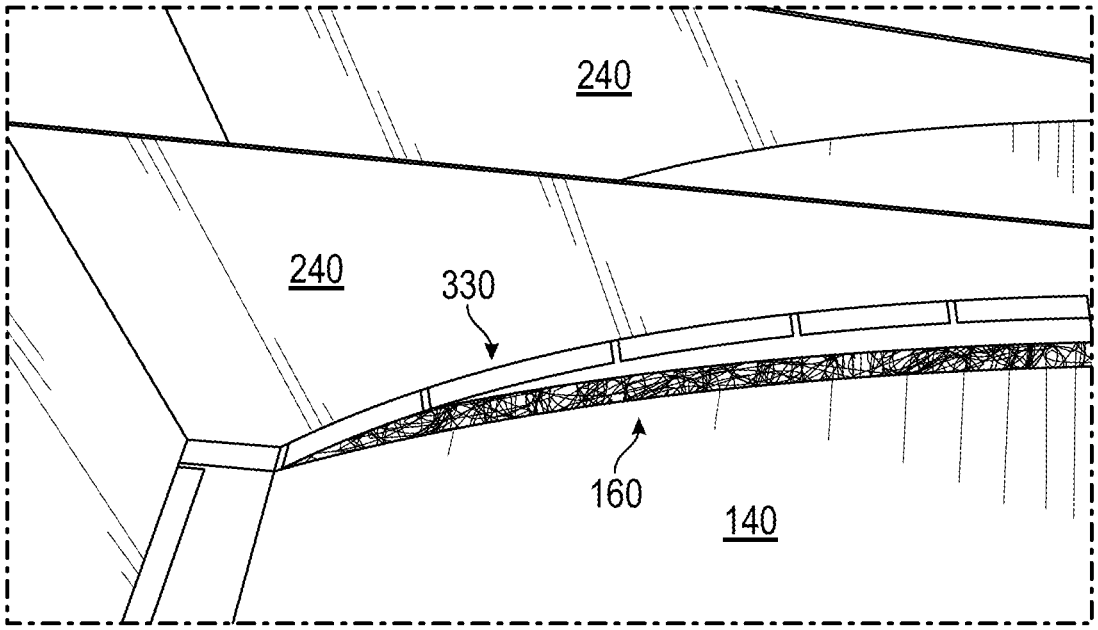
FIG. 10 is another partial perspective view of the second of two inverted ramp supports of FIG. 4 being attached to the ramp member of the ramp of FIG. 1.
Figure 11:
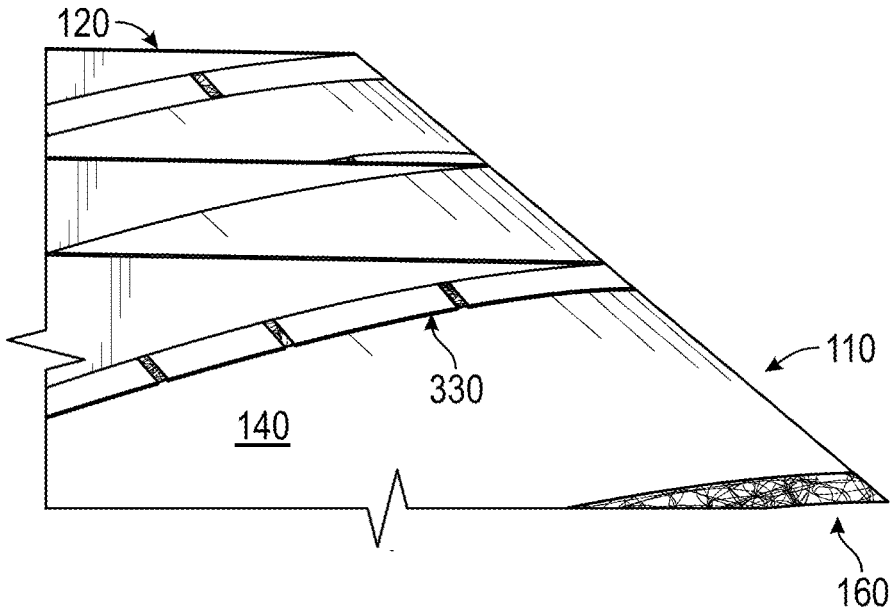
FIG. 11 is a further partial perspective view of the second of two inverted ramp supports of FIG. 4 being attached to the ramp member of the ramp of FIG. 1.
Figure 12:
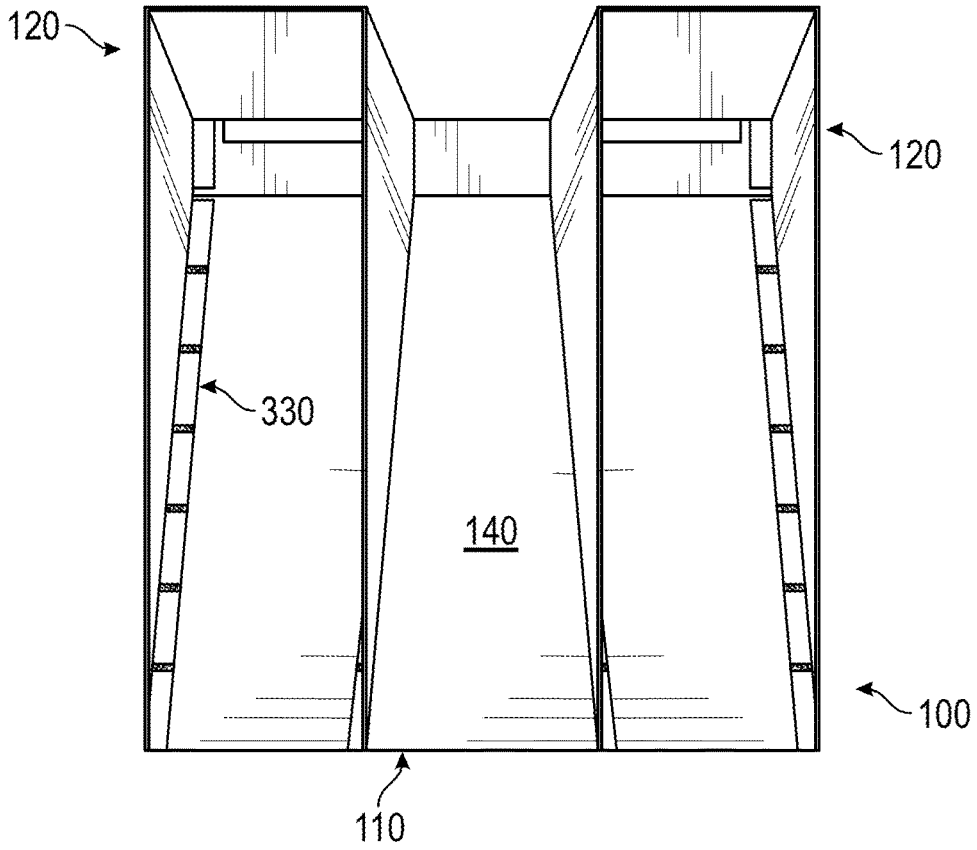
FIG. 12 is a bottom perspective view of the two inverted ramp supports of FIG. 4 shown attached to the ramp member of the ramp of FIG. 1.

With reference initially to FIGS. 1-2, the ramp 100 includes a light-weight flexible plastic ramp member 110 and one or more (e.g., two) light-weight plastic ramp supports 120 that support the ramp member 110. The ramp member 110 and the ramp supports 120 are in the flat, two-dimensional configuration shown in FIG. 2 and the ramp member 110 and the ramp supports 120 stacked in a low-profile/flat configuration during shipping and transport.

The ramp member 110 is rectangular and includes an upper surface 130 that wheels of wirelessly controlled vehicles ride over and an undersurface 140 that the ramp supports 120 directly contact and support. The undersurface 140 includes a first pair/set 150 of longitudinally arranged fasteners (e.g., hook and loop fastener strips) 160, and a second pair/set 170 of longitudinally arranged fasteners 160. The ramp member 110 includes a lower end 180 and an upper portion 190 including a fold line 200 and an upper end 210. Laterally arranged fasteners 220 for each set 150, 170 of longitudinally arranged fasteners 160 are disposed along the upper end 210.

The ramp supports 120 include a main panel 230 and two side panels 240 that are hinged to the main panel 230 at fold lines 250. The main panel 230 is rectangular and the two side panels 240 are substantially triangular. The main panel 230 includes a lower end 260 and an upper end 270 with laterally arranged fastener(s) 280. The two side panels 240 include a lower end 290 and an upper end 300. The lower end 290 of one of the side panels 240 of each ramp support includes ground securement devices 310. The upper end 300 of the side panels 240 includes a curved segment 320 with fastener(s) 330 for most of the upper end 300 and a straight segment 340 with fastener(s) 350 adjacent to the upper end 270 of the main panel 230.

Figure 15:
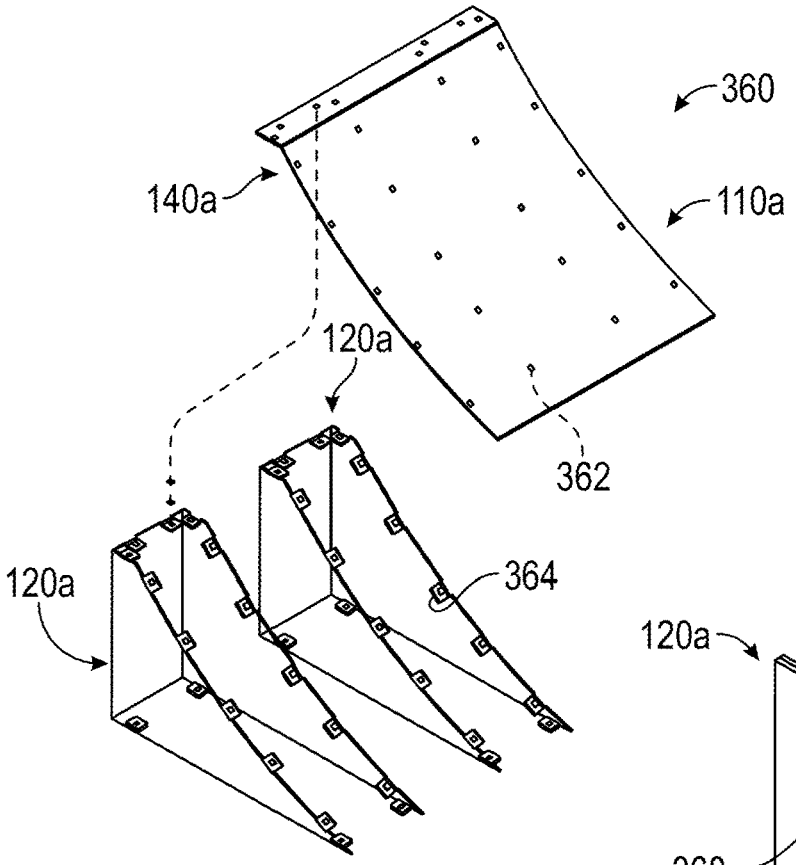
FIG. 15 is an exploded perspective view of another embodiment of a ramp for jumping wirelessly controlled vehicles.

FIG. 15 illustrates another embodiment of a ramp 360 for jumping wirelessly controlled vehicles. Similar features of the ramp 360 compared to those of the ramp 100 will be shown with the same reference number, but an "a" suffix. The description of the ramp 100 is incorporated herein. The ramp 360 is similar to the ramp 100, except that fasteners 160, 220 are replaced with spaced fastener segments 362 on the undersurface 140*a* of the ramp member 110*a* and the fasteners 280, 350 are replaced with spaced fastener tabs 364 on the ramp supports 120*a*. The fastener tabs 364 and the fastener segments 362 may include, for example, but not by way of limitation, hook and loop fasteners, to attach the ramp member 110*a* to the ramp supports 120*a*.

Figure 16:
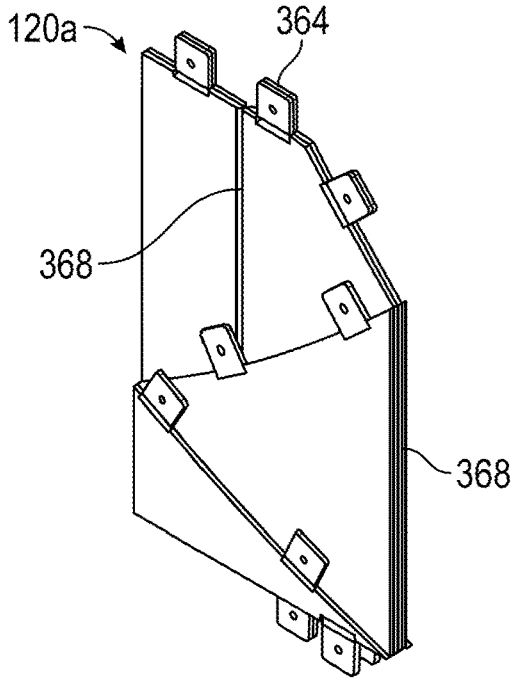
FIG. 16 is a perspective view of one of the ramp supports of the ramp of FIG. 15 and shows the ramp support in a folded, flat or two-dimensional configuration.
Figure 17:
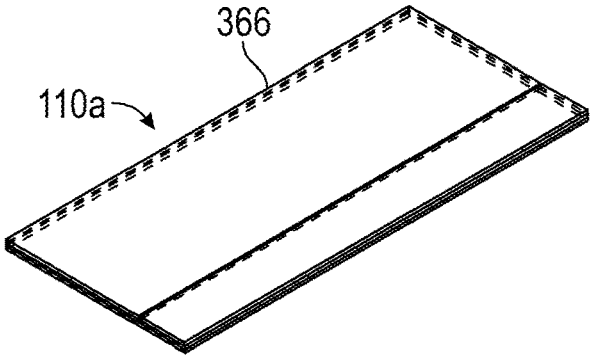
FIG. 17 is a perspective view of a ramp member of the ramp of FIG. 15 and shows the ramp member in a folded, flat or two-dimensional configuration.

As illustrated in FIGS. 16 and 17, the ramp member 110*a* and the ramp supports 120*a* also include fold lines 366, 368 to fold the ramp member 110*a* and the ramp supports 120*a* into and out of the folded, flat or two-dimensional configurations shown in FIGS. 16, 17 for flat, compact storage or shipping of the ramp member 110*a* and the ramp supports 120*a*.

With reference to FIGS. 3-17 and 19, a method 400 of using the ramp 100, 360 will be described. To assemble the ramp 100, 360, in box 410, the two-dimensional ramp supports 120, 120*a* are assembled into a three-dimensional configuration. In box 420, the two-dimensional ramp member 110, 110*a* is coupled to the assembled three-dimensional ramp supports 120, 120*a* to form the ramp 100, 360 with the three-dimensional ramp member 110, 110*a*. In box 430, the ramp 100, 360 is provided so that it is supported on a surface by the one or more three-dimensional ramp supports 120, 120*a*.

Figure 13:
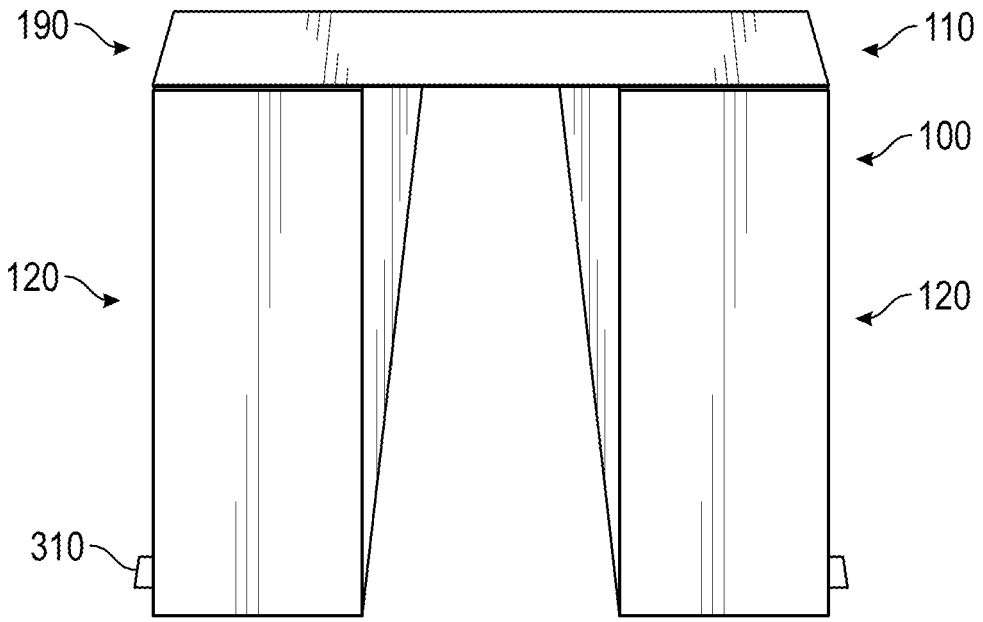
FIG. 13 is a rear perspective view of the assembled ramp of FIG. 1.
Figure 14:
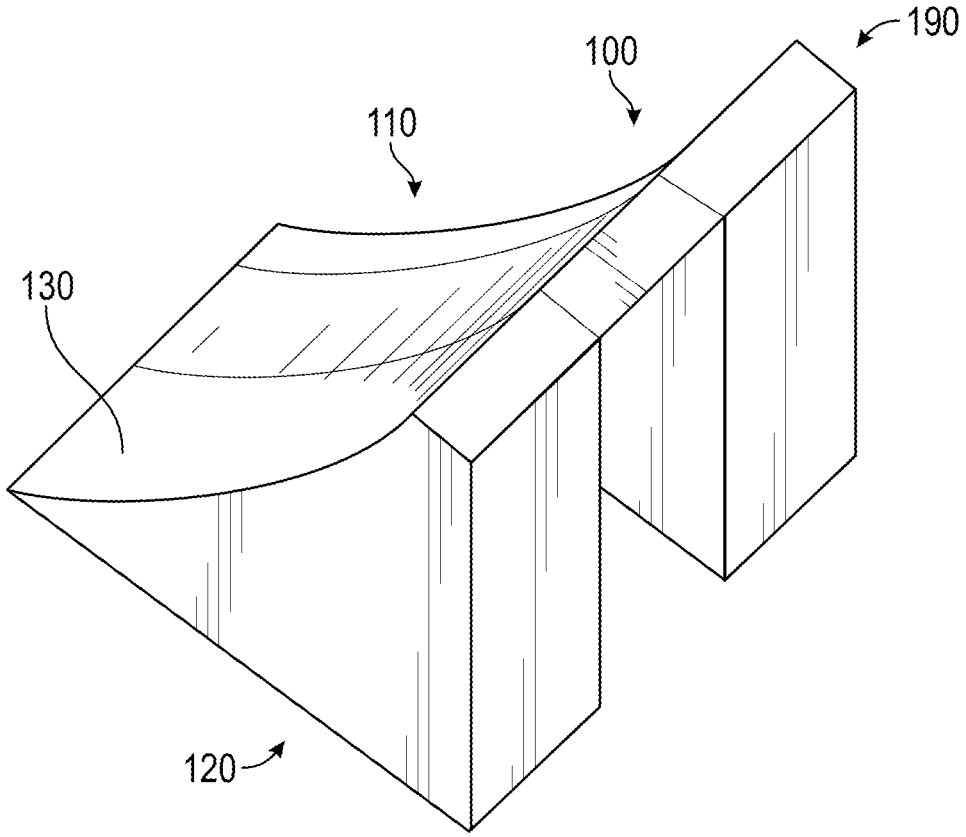
FIG. 14 is a side rear perspective view of the assembled ramp of FIG. 1.

In other embodiments, one or more operations shown in blocks 440-540 may be performed. In box 440, the two-dimensional ramp supports 120, 120*a* are assembled by folding the side panels 240 about the vertical fold lines 250 relative to the main panel 230 so that the side panels 240 are 90 degrees and facing in the same direction relative to the main panel 230. In box 450, the two-dimensional ramp member 110, 110*a* is coupled to the curved segment(s) 320 of the assembled three-dimensional ramp support(s) 120, and, in box 460, the two-dimensional ramp member 110, 110*a* is coupled to the straight segment(s) 340 of the upper end 270 of the assembled three-dimensional ramp support(s) 120, 120*a* to form a ramp with a curved, three-dimensional ramp member having a flat upper portion 190. The fasteners 160, 362 of the ramp member 110, 110*a* are fastened to the fasteners 330, 364 of the curved segment 320 and the fasteners 350, 364 of the straight segment 340 of the ramp supports 120, 120*a*. Further, the fasteners 220, 362 of the ramp member 110, 360 are fastened to the fasteners 280, 364 of the ramp supports 120, 120*a*. In FIGS. 5-12 and 19, in box 470, the coupling step(s) are facilitated with the ramp member 110, 360 upside down (i.e., ramp member 110, 110*a* on the ground with the undersurface 140 of two-dimensional ramp member 110, 110*a* facing upward) and the ramp supports 120, 120*a* inverted (i.e., curved segments 320, straight segments 340 facing downward). With the ramp 100, 360 assembled, in box 480, the ramp 100, 360 is inverted so that the upper surface 130 of the ramp member 110, 110*a* is facing upward, as shown in FIGS. 1, 13, 14. If the ramp 100 is being used on grass or turf, in box 480, ground securement devices 310 may be used to secure the ramp 100, 360 to the ground. To disassemble the ramp 100, 360 in box 490, the various fasteners are unfastened/detached, and the ramp member 110, 110*a* and the ramp supports 120, 120*a* are put in the flat configuration shown in FIGS. 2, 16, 17 and stacked in a low-profile/flat configuration for convenient flat storage to facilitate transportation and storage.

The ramp 100, 360 (or multiple ramp members) is placed near objects/areas to be jumped and wirelessly controlled vehicles are wireless controlled to jump using the ramp 100, 360. The curved segment 320 is steeper than ramps in the past, enabling wirelessly controlled vehicles to get more vertical distance than was available with ramps in the past. Also, the ramp member 110, 110*a* is wider than ramps in the past, making it easier to control wirelessly controlled vehicles to engage the ramp 100, 360 for jumping.

Figure 18:
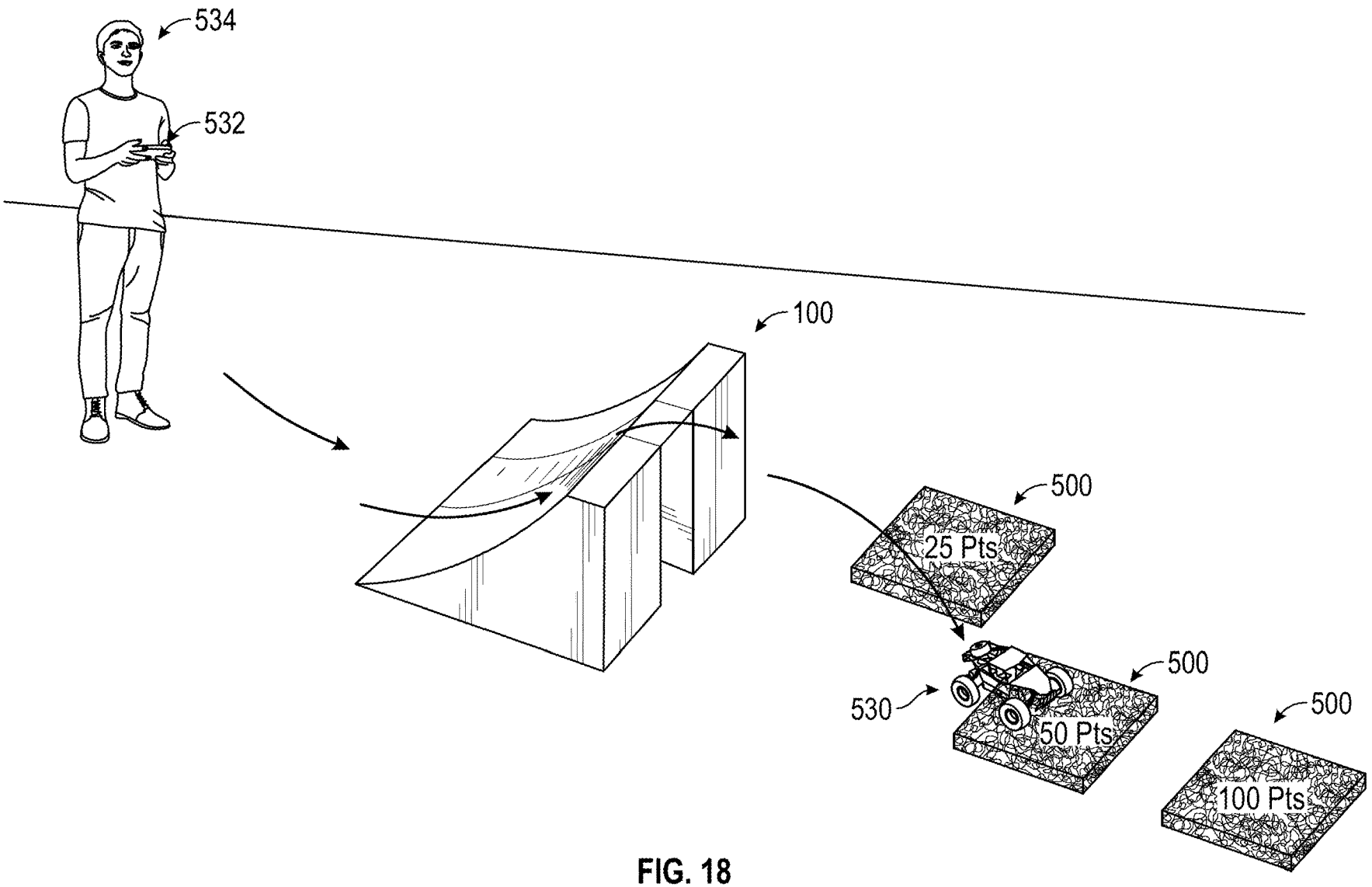
FIG. 18 is a perspective view of the assembled ramp and shows the ramp used in conjunction with a scoring game.
Figure 19:
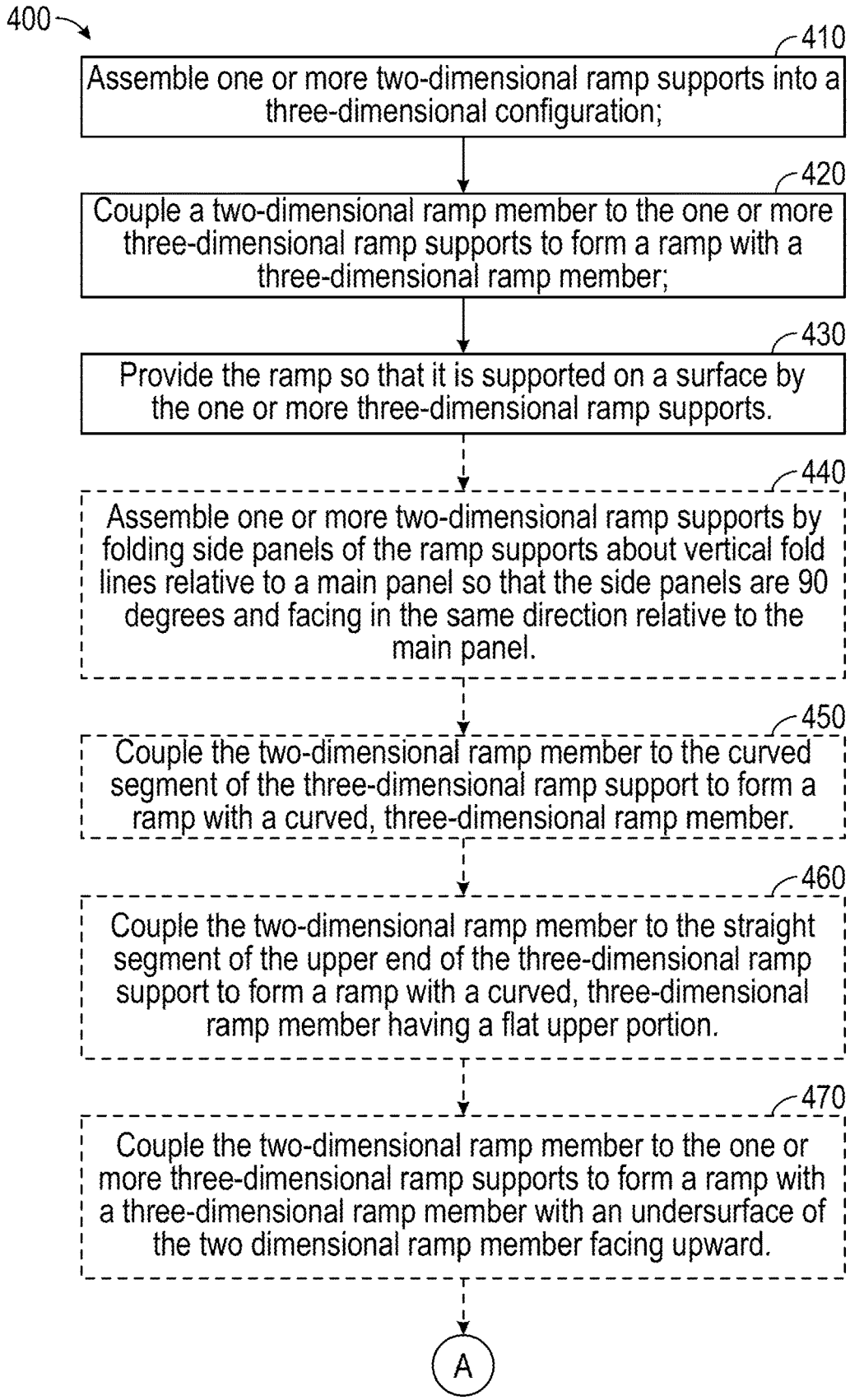
FIG. 19 is a flow chart of an exemplary method of using the ramp.
Figure 19:
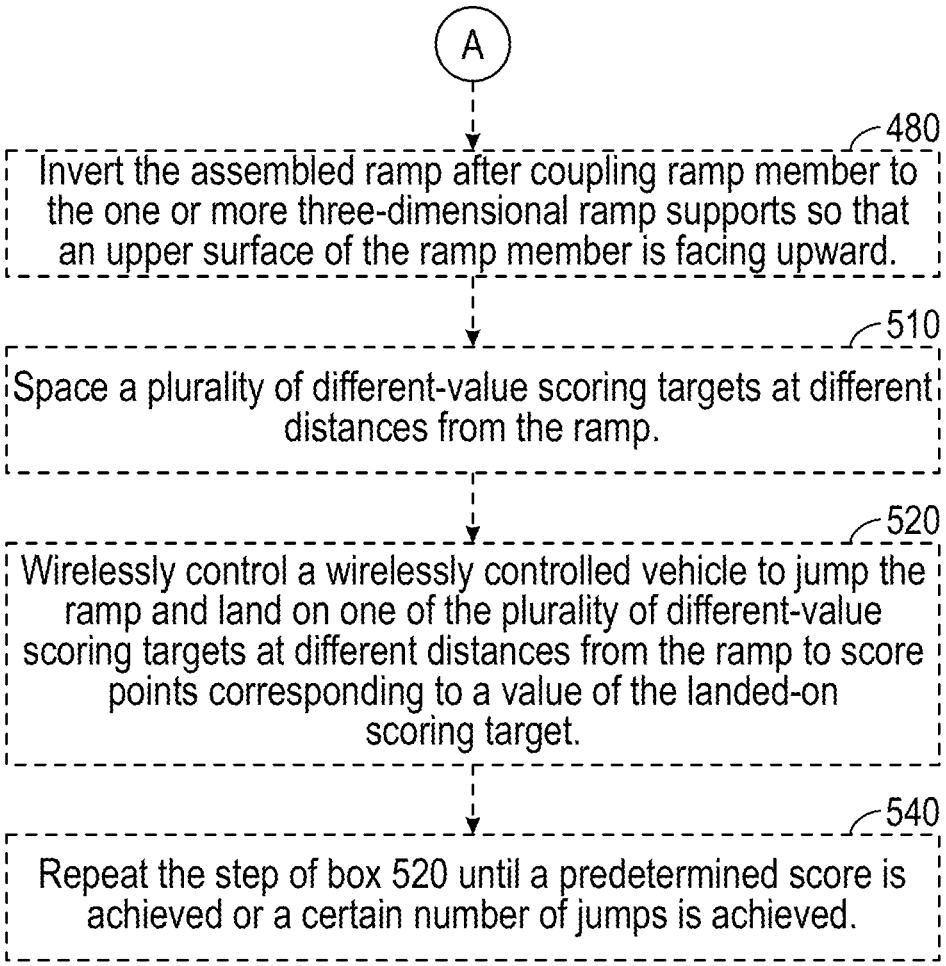

With reference additionally to FIGS. 18 and 19, a method of using the ramp 100, 360 as part of a game will be described. The game may be part of or separate from the method 400 described herein. A plurality of different-value scoring targets 500 are, in box 510, spaced at different distances from the ramp 100, 360. The scoring targets 500 are impact mats/landing pads with different numeric values (e.g., 25 points, 50 points, 100 points). The scoring targets 500 may be made of a gel material or a foam material, and approximately 3 ft by 3 ft in length/width. The scoring targets 500 provide impact absorption from the jump and as a way to collect points. In box 520, a wirelessly controlled vehicle 530 is wirelessly controlled by a wireless controller 532 controlled by a participant 534 to jump the ramp 100, 360 and land on one of the plurality of different-value scoring targets 500 at different distances from the ramp 100, 360 to score points corresponding to a value of the landed-on scoring target 500. One attempts to jump one's wirelessly controlled vehicle 530 with the ramp 100, 360 and land on one of the different-value scoring targets 500. Multiple participants 534 may compete, jump their wirelessly controlled vehicle 530, and add the numbers shown on the landed-on, different-value scoring targets 500 to arrive at a score. The step in box 520 may, in box 540, be repeated, and the winner, for example, may be the participant 534 that has the highest score after a predetermined number (e.g., 3) jumps or may be the participant 534 that is first to reach a minimum score, regardless of the number of jumps. In one or more implementations of the game, each participant is given three jumps to accumulate the most points; the game may be a single-player game or a multiplayer game; if the participant 534 is unable to launch off the ramp 100, 360, going off the sides or missing the ramp 100, 360, the participant 534 forfeits the turn; no more than three runs are allowed per participant 534; in the event of a tie after three runs, each tied participant 534 gets one extra run until high score winner is determined.

While various embodiments of the present invention have been described above, it should be understood that they have been presented by way of example only, and not of limitation. Likewise, the various diagrams may depict an example architectural or other configuration for the disclosure, which is done to aid in understanding the features and functionality that can be included in the disclosure. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present disclosure.

Although the disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent.

I claim:

1. A method of using a ramp for jumping wirelessly controlled vehicles, comprising:

assembling one or more two-dimensional ramp supports into a three-dimensional configuration;

coupling a two-dimensional ramp member to the one or more three-dimensional ramp supports to form a ramp with a three-dimensional ramp member;

providing the ramp so that it is supported on a surface by the one or more three-dimensional ramp supports;

spacing a plurality of different-value scoring targets at different distances from the ramp;

wireless controlling a wirelessly controlled vehicle to jump the ramp and land on one of the plurality of different-value scoring targets at different distances from the ramp to score points corresponding to a value of the landed-on scoring target.

2. The method of claim 1, wherein:

assembling one or more two-dimensional ramp supports by folding side panels of the ramp supports about vertical fold lines relative to a main panel so that the side panels are 90 degrees and facing in the same direction relative to the main panel.

3. The method of claim 1, wherein the one or more three-dimensional ramp supports includes a curved segment, and:

coupling includes coupling the two-dimensional ramp member to the curved segment of the one or more three-dimensional ramp supports to form a ramp with a curved, three-dimensional ramp member.

4. The method of claim 1, wherein the one or more three-dimensional ramp supports includes a pair of spaced three-dimensional ramp supports, and:

coupling includes coupling the two-dimensional ramp member to the pair of spaced three-dimensional ramp supports.

5. The method of claim 1, wherein:

coupling includes coupling the two-dimensional ramp member to the one or more three-dimensional ramp supports to form a ramp with a three-dimensional ramp member with an undersurface of the two dimensional ramp member facing upward.

6. The method of claim 5, further comprising:

inverting the assembled ramp after coupling ramp member to the one or more three-dimensional ramp supports so that an upper surface of the ramp member is facing upward.

7. The method of claim 1, further comprising:

repeating the wireless controlling a wirelessly controlled vehicle to jump the ramp and land on one of the plurality of different-value scoring targets step until a predetermined score is achieved or a certain number of jumps is achieved.

8. A method of using a ramp for jumping wirelessly controlled vehicles, comprising:

providing one or more ramp supports;

coupling a ramp member to the one or more ramp supports to form a ramp;

providing the ramp so that it is supported on a surface by the one or more ramp supports;

spacing a plurality of different-value scoring targets at different distances from the ramp;

wireless controlling a wirelessly controlled vehicle to jump the ramp and land on one of the plurality of different-value scoring targets at different distances from the ramp to score points corresponding to a value of the landed-on scoring target.

9. The method of claim 8, wherein:

providing one or more ramp supports includes assembling the one or more ramp supports from a flat configuration to a non-flat, three-dimensional configuration by folding side panels of the ramp supports about fold lines relative to a main panel so that the side panels are facing in the same direction relative to the main panel.

10. The method of claim 8, wherein the one or more ramp supports includes a pair of spaced ramp supports, and:

coupling includes coupling the ramp member to the pair of spaced ramp supports.

11. The method of claim 8, further comprising:

repeating the wireless controlling a wirelessly controlled vehicle to jump the ramp and land on one of the plurality of different-value scoring targets step until a predetermined score is achieved or a certain number of jumps is achieved.

12. A method of using a ramp for jumping wirelessly controlled vehicles, comprising:

providing a pre-assembled ramp including one or more ramp supports and a ramp member in a flat configuration;

assembling the pre-assembled ramp from the flat configuration to a non-flat, three-dimensional configuration;

providing the assembled ramp in the non-flat, three-dimensional configuration so that it is supported on a surface by the one or more ramp supports;

spacing a plurality of different-value scoring targets at different distances from the assembled ramp;

wireless controlling a wirelessly controlled vehicle to jump the assembled ramp and land on one of the plurality of different-value scoring targets at different distances from the assembled ramp to score points corresponding to a value of the landed-on scoring target.

13. The method of claim 12, further comprising:

repeating the wireless controlling a wirelessly controlled vehicle to jump the assembled ramp and land on one of the plurality of different-value scoring targets step until a predetermined score is achieved or a certain number of jumps is achieved.

* * * * *